US006456011B1

(12) United States Patent
Bugrova et al.

(10) Patent No.: US 6,456,011 B1
(45) Date of Patent: Sep. 24, 2002

(54) MAGNETIC FIELD FOR SMALL CLOSED-DRIFT ION SOURCE

(75) Inventors: Antonina Ivanovna Bugrova; Aleksei Vasilievich Desiatskov; Aleksei Ivanovich Morozov; Vadim Konstantinovich Kharchevnikov, all of Moscow (RU); Harold R. Kaufman, LaPorte; Viacheslav V. Zhurin, Ft. Collins, both of CO (US)

(73) Assignee: Front Range Fakel, Inc., Ft. Collins, CO (US)

( * ) Notice: Subject to any disclaimer, the term of this patent is extended or adjusted under 35 U.S.C. 154(b) by 0 days.

(21) Appl. No.: 09/854,170

(22) Filed: May 11, 2001

Related U.S. Application Data

(60) Provisional application No. 60/271,042, filed on Feb. 23, 2001.

(51) Int. Cl.[7] ..... H01J 7/24

(52) U.S. Cl. ..... 315/111.91; 315/111.41; 313/361.1; 313/362.1; 250/423 R

(58) Field of Search ..... 315/111.91, 111.41, 315/111.61, 111.21, 111.81; 313/361.1, 362.1, 231.31, 359.1; 250/423 R, 423 F

(56) References Cited

U.S. PATENT DOCUMENTS 4,862,032 A * 8/1989 Kaufman et al. ..... 313/359.1
5,359,258 A * 10/1994 Arkhipov et al. ..... 313/359.1
5,763,989 A * 6/1998 Kaufman ..... 313/361.1
6,150,764 A * 11/2000 Hruby et al. ..... 315/111.61

* cited by examiner

*Primary Examiner*—Don Wong
*Assistant Examiner*—Tuyet T. Vo
(74) *Attorney, Agent, or Firm*—Dean P. Edmundson

(57) ABSTRACT

In one embodiment of a compact closed-drift ion source, an ionizable gas is introduced into a annular discharge region. An anode is at one end of this region and an electron-emitting cathode is near the opposite and open end. A magnetic circuit extends from an inner pole piece to an outer pole piece, with both pole pieces near the open end. The electron current in the discharge region interacts with the magnetic field therein to generate and accelerate ions out of the open end. A permeable enclosure surrounds the anode end of the discharge region. Adjacent elements of the permeable enclosure, the inner pole piece, and any intermediate permeable elements are in close proximity, one to the next. A magnetizing means is located only between the outer pole piece and the permeable enclosure.

8 Claims, 6 Drawing Sheets

MAGNETIC FIELD FOR SMALL CLOSED-DRIFT ION SOURCE

CROSS-REFERENCE TO RELATED APPLICATION

This application is based upon, and claims the benefit of, our Provisional Application No. 60/271,042, filed Feb. 23, 2001.

FIELD OF INVENTION

This invention relates generally to ion and plasma technology, and more particularly it pertains to plasma and ion sources with closed electron drift.

This invention can be used in industrial applications such as sputter etching, sputter deposition, and property enhancement. It can also find application in electric space propulsion.

BACKGROUND ART

The acceleration of ions to form energetic beams of such ions has been accomplished both electrostatically and electromagnetically. The present invention pertains to sources that utilize electromagnetic acceleration. Such sources have in general been called electromagnetic or gridless ion sources. Because the ion beams are typically dense enough to require the presence of electrons to avoid the disruptive mutual repulsion of the positively charged ions, the ion beams are also neutralized plasmas and these ion sources are also called plasma sources. When the ion sources are used for space propulsion, they are called thrusters.

In ion sources (or thrusters) with electromagnetic acceleration, there is a discharge between an electron-emitting cathode and an anode. An electric field for accelerating ions is established by the interaction of the electron current in this discharge with a magnetic field created in the discharge region between the anode and cathode. This interaction generally includes a Hall current normal to both the magnetic field direction and the direction of the electric field that is established. This Hall current consists primarily of electrons.

The present invention pertains to a Hall current ion source, i.e., one that employs a Hall current, where the discharge region has a generally annular shape with both inner and outer boundaries, and where the ions are accelerated only over the annular cross section of this region. This type of Hall current ion source is also called a closed-drift source because the Hall current of drifting electrons follows a closed path around the annular discharge region. This type of Hall-current ion source usually has a generally radial magnetic field shape in the discharge region as described in U.S. Pat. No. 5,359,258—Arkhipov, et al., U.S. Pat. No. 5,763,989—Kaufman, and a review paper by Zhurin, et al., in *Plasma Sources Science & Technology*, Vol. 8, beginning on page R1. These publications are incorporated herein by reference.

It should be noted that a Hall-current ion source can also have a circular discharge region with only an outside boundary, where the ions are accelerated continuously over the circular cross section of this region. This type of ion source is called an end-Hall ion source and has a generally axial magnetic field shape as described in U.S. Pat. No. 4,862,032—Kaufman et al, and an article by Kaufman, et al., in *Journal of Vacuum Science and Technology A*, Vol. 5, No. 4, beginning on page 2081. These publications are incorporated herein by reference. This type of ion source is mentioned to distinguish it from the closed-drift ion source of interest herein.

It should be further noted that the closed-drift ion source of interest herein is generally of the magnetic-layer or SPT (stationary plasma thruster) type. The differences between this type of closed-drift ion source and the other major closed-drift type, the anode-layer type, are described by Zhurin, et al., in the aforesaid review paper in *Plasma Sources Science & Technology*, Vol. 8, beginning on page R1. In geometry, the magnetic-layer or SPT type has a discharge region that has a length greater than its width, while the anode-layer type has a discharge region that has a length less than its width, where the width of the discharge region in both cases is the radial distance between the inner and outer boundaries of the discharge region. The preferred magnetic field configuration for the magnetic-layer type is one where the magnetic field is generally radial, concentrated near the exit plane, and has a much decreased strength near the anode at the upstream end of the discharge region.

There is interest in small ion sources, as indicated by Guerrini, et al, in *Proceedings of the 24th International Electric Propulsion Conference* (Moscow, 1995) beginning on page 259; by Guerrini, et al, in *Proceedings of the 25th International Electric Propulsion Conference* (Cleveland, Ohio, 1997) beginning on page 326; and by Khayms, et al., also in *Proceedings of the 25th International Electric Propulsion Conference* (Cleveland, Ohio, 1993) beginning on page 483. These publications were directed primarily toward electric space propulsion, but there is also interest in small ion sources for industrial applications as indicated by the commercial Mark I end-Hall ion source manufactured originally by Commonwealth Scientific Corporation and now manufactured by Veeco Instruments Inc.

One might expect that a small closed-drift ion source could be made by geometrically scaling down a larger source of the same type—i.e., by reducing the dimensions of all parts by the same factor. The flux densities in the permeable portions of the magnetic circuit will increase if this approach is carried out, and will reach a saturation value in some part of the magnetic circuit if there is sufficient reduction in size. Because space is most limited in the region within the inside diameter of the discharge region, the saturation value will usually be reached in the inner path of the magnetic circuit, typically at the upstream end of this element of the magnetic circuit

SUMMARY OF INVENTION

In light of the foregoing, it is an overall general object of the invention to provide a magnetic field configuration suitable for a small closed-drift ion source that performs efficiently over a wide operating range, is generally of the magnetic-layer or SPT type, and can be used in a variety of industrial and space propulsion applications that require an ion source or thruster of small size.

Another overall general object of the invention is to provide a magnetic field configuration that is efficient in the use of magnetic circuit elements so that it is suitable for a larger closed-drift ion source that is of the magnetic-layer or SPT type and is compact, efficient, and economical in the use of magnetically permeable material for the ion beam energy and current generated.

A specific object of the present invention is to optimize the shape of the magnetic field without the use of an inner electromagnet which would reduce the permissible cross section of the inner path of the magnetic circuit and add resistive heating to one of the hottest regions of a closed-drift ion source.

Another specific object of the present invention is to minimize the magnetic flux passing through the inner path of the magnetic circuit that does not directly contribute to the ionization and acceleration process, thereby reducing the flux density in that element of the magnetic circuit.

A more general object of the present invention is to minimize the gas flow required for operation by making a closed-drift ion source that has a discharge region with a small mean diameter.

In accordance with one specific embodiment of the present invention, a compact closed-drift ion source takes a form that includes a means for introducing a gas, ionizable to produce a plasma, into an annular discharge region. An anode is located at one end of this region and an electron-emitting cathode is located near the opposite and open end. A magnetic circuit including magnetically permeable elements and at least one magnetizing means extends from an inner pole piece to an outer pole piece, with both pole pieces located near the open end. The electron current from the cathode to the anode in the discharge region interacts with the magnetic field therein, ionizes the gas to generate ions, and accelerates these ions out of the open end. Permeable elements of the magnetic circuit form a permeable enclosure that surrounds the anode end of the discharge region. Adjacent elements of the permeable enclosure, the inner pole piece, and any intermediate permeable elements are in close proximity, one to the next. A magnetizing means is located only between the outer pole piece and the permeable enclosure.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that the aforesaid schematic views represent the surfaces in the plane of the section while avoiding the clutter which would result were there also a showing of the background edges and surfaces of the overall generally-cylindrical assemblies.

DESCRIPTION OF PRIOR ART

Figure 1:
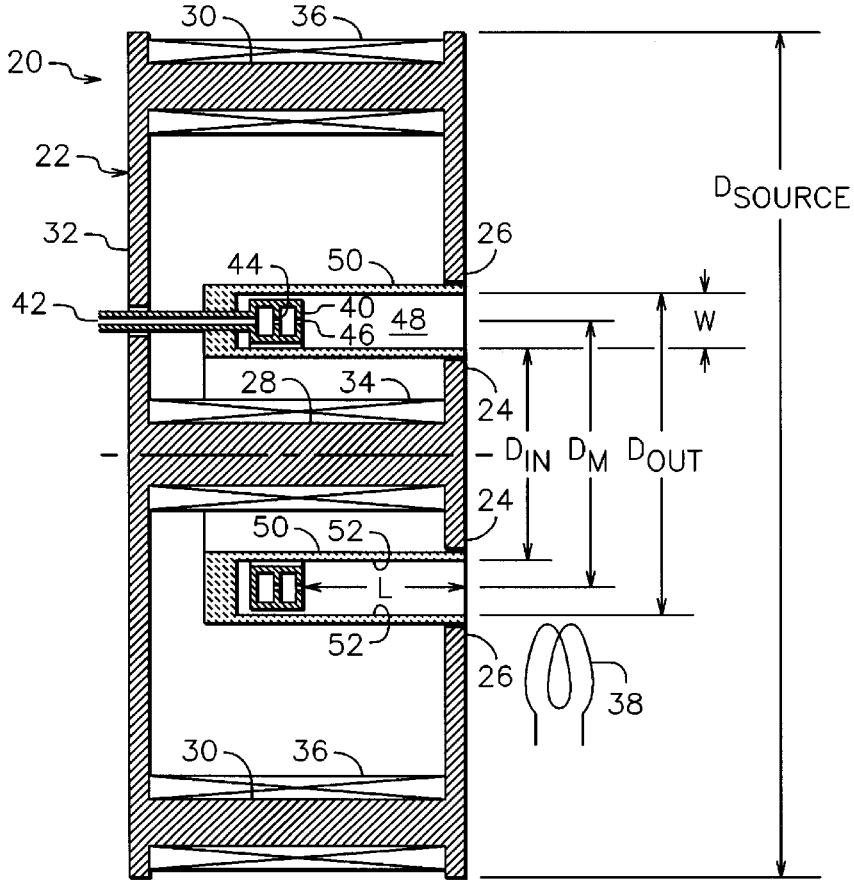
FIG. 1 (PRIOR ART)
FIG. 1 is a cross-sectional view of a prior-art closed-drift ion source.

Referring to FIG. 1, there is shown an approximately axisymmetric closed-drift ion source of the prior art, more particularly one of the magnetic-layer type. Ion source 20 includes a magnetic circuit 22, which is comprised of magnetically permeable inner pole piece 24, magnetically permeable outer pole piece 26, magnetically permeable inner path 28, one or more magnetically permeable outer paths 30, magnetically permeable back plate 32, inner magnetically energizing coil 34 surrounding inner path 28, one or more outer magnetically energizing coils 36 surrounding outer paths 30, all of which serve, when coils 34 and 36 are energized by appropriate sources of electrical power, to generate a magnetic field between the inner and outer pole pieces. Electron-emitting cathode 38 is connected to the negative terminal of a discharge power supply (not shown), while anode 40 is connected to the positive terminal of the same power supply. Except for a single gas flow passage 42, the usually laterally offset electron-emitting cathode 38, and the typical use of several discrete magnetically permeable outer paths 30 and outer magnetically energizing coils 36, the apparatus shown in FIG. 1 is symmetric about a central axis. Magnetically energizing coils are shown in FIG. 1, and are in fact the most commonly used magnetizing means. Permanent magnets have also been used and are therefore assumed to be included in the prior art.

Some frequently used dimensions are also shown in FIG. 1, including $D_{IN}$, the inside diameter of the discharge region; $D_{OUT}$, the outside diameter of the discharge region; $D_M$, the mean diameter of the discharge region ($D_M=(D_{IN}+D_{OUT})/2$); W, the width of the discharge region; L, the length of the discharge region from the anode to the exit plane; and $D_{SOURCE}$, the overall diameter of the closed-drift source. The outside contour of the source may be irregular, in which case the maximum transverse dimension of the source is $D_{SOURCE}$.

During operation, an ionizable gas enters anode 40 through flow passage 42. The ionizable gas is uniformly distributed around the circumference within anode 40 by distributor means 44 (in this case two circumferential passages with a baffle between them), and leaves through circumferentially distributed apertures 46. Some of the electrons emitted by cathode 38 flow back through discharge region 48 toward anode 40, drifting circumferentially around the annular discharge region due to the magnetic field therein. Discharge channel 50 that surrounds discharge region 48 is made of a high-temperature, ceramic-like material, so that there is no net current to this channel. Due to the circumferential drifting motion, these electrons effectively ionize the molecules of ionizable gas leaving anode 40 through apertures 46, thereby generating a plasma (a gaseous mixture of electrons and ions) in discharge region 48. These electrons also interact with the magnetic field in region 48 to establish an axial electric field (not shown) within region 48. The presence of the magnetic field thus serves to enhance the ionization of the molecules of ionizable gas, as well as subsequently, through the axial electric field, to accelerate the ions that are formed. The ions that do not recombine with electrons on surfaces of anode 40 and walls 52 of discharge channel 50 are accelerated outward (to the right in FIG. 1) by the axial electric field to form an energetic ion beam. Some of the electrons that leave cathode 38 charge neutralize and, if necessary, current neutralize this ion beam.

Figure 2:
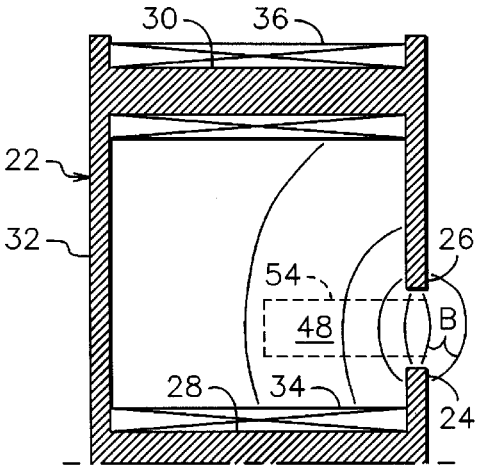
FIG. 2 (PRIOR ART)
FIG. 2 is a schematic cross-sectional view of the prior-art closed-drift ion source of FIG. 1 showing the shape of the magnetic field.

Referring now to FIG. 2, there is shown a schematic cross section of the closed-drift ion source shown in FIG. 1. The parts not associated with the magnetic circuit are omitted in FIG. 2 in order to better show the shape of the magnetic field B. The boundary of the discharge region 48, defined at one end by anode 40 and laterally by discharge channel walls 52, is shown by dashed line 54.

A normal procedure in the initial operation of an ion source of the type shown in FIG. 1 is to optimize the current ratio between the inner magnetically energizing coil 34 and the one or more outer magnetically energizing coils 36. This optimization is required to establish an approximately radial field direction in discharge region 48 enclosed by dashed line 54 and is typically verified by obtaining a collimated ion beam, i.e., one with minimum divergence. Although the field strength may be adjusted for different operating conditions, the current ratio determined during this optimization is usually held constant over a wide range of operating conditions. It should be mentioned that the field direction is described as "approximately" radial because the desired axial variation in magnetic field strength from the anode to the exit plane will, as can be shown from Laplace's equation, result in a curvature of magnetic field lines. This curvature will permit a particular field direction at only one radius at a given axial location, with the direction departing slightly from radial at other radii at the same axial location.

Figure 3:
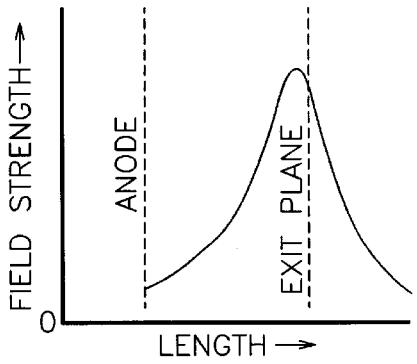
FIG. 3 (PRIOR ART)
FIG. 3 depicts the axial variation of the magnetic field strength in the closed-drift ion source of FIG. 1 at the mean diameter of the discharge region.

The axial variation of magnetic field strength at the mean diameter of the discharge region for the ion source of FIG. 1 is shown in FIG. 3. The field strength is highest in the vicinity of pole pieces 24 and 26, which is also where most of the ion acceleration takes place. The field strength drops to a small value near the anode, which is desirable for high efficiency and stability over a wide operating range for a magnetic-layer type of closed-drift ion source.

Solutions of the magnetic field B in the drawings can be obtained by taking the gradient $\nabla$ of a scalar function $\psi$, which is called the magnetostatic potential.

$$B=-\nabla\psi \tag{1}$$

Values of the magnetostatic potential can be set at the boundaries of the region of interest, i.e., at the surfaces of the various elements of the magnetic circuit. Solution of the magnetic field B over a region by using boundary values of magnetostatic potential $\psi$ is the mathematical analogue of solving for the electric field E over a region by using boundary values of electric potential V. In practice, numerical solutions of Laplace's equation for magnetic fields (or electric fields) in regions of interest can be obtained with computers using a relaxation method.

Referring back to FIG. 2, it is evident to one skilled in the art of magnetic fields that there is a magnetostatic potential difference between inner and outer pole pieces 24 and 26 located at the radially inward and radially outward sides of discharge region 48 and that this potential difference is approximately equal to the sum of the magnetostatic potential differences generated by magnetically energizing coils 34 and 36. There are only small differences in magnetostatic potential in the magnetically permeable elements, due to the high but still finite relative permeabilities of these parts. From this understanding of the relationship between the magnetostatic potentials at the boundaries of the magnetic circuit elements and the field shape generated, it should also be evident that the large decrease in magnetic field strength in FIG. 3 from the exit plane to the anode is consistent with the geometry of the magnetic circuit shown in FIG. 2—specifically that the pole pieces 24 and 26 are much closer together than the inner and outer paths 28 and 30.

One might expect that a compact, small closed-drift ion source could be obtained by reducing the size of all the elements shown in FIG. 1 by the same factor. As discussed by Zhurin, et al., in the aforesaid review paper in *Plasma Sources Science & Technology*, Vol. 8, beginning on page R1, the magnetic field strength B in ion sources that are geometrically similar (all parts scaled in proportion) can be described by the proportionality $$B\ 1/W, \tag{2}$$

where W is the width of the annular discharge region. The total magnetic flux $\phi_M$ between the two pole pieces can then be given as $$\phi_M\ (\text{magnetic field strength})\times(\text{length})\times(\text{circumference})\ LD_m/W, \tag{3}$$

where L is the length of the discharge region and $D_M$ is the mean diameter of the discharge region and therefore proportional to the circumference.

In geometric scaling, the ratios $L/D_M$ and $W/D_M$ will remain constant, so that the preceding equation can also be written as $$\phi_M\ D_m. \tag{4}$$

The cross-sectional area of the inner path of the magnetic circuit through which this magnetic flux passes, $A_{IN}$, can be described as $$A_{IN}\ D_M{}^2. \tag{5}$$

Dividing the magnetic flux of proportionality (4) by the inner path area of proportionality (5), the flux density in the inner path is found to be $$\phi_M/A_{IN}\ 1/D_M. \tag{6}$$

In other words, the flux density in the inner path of the magnetic circuit varies inversely with the mean diameter of the discharge region or, because the scaling is geometric, inversely with the size of any characteristic dimension.

The inner path was selected for this flux density calculation because that part of the magnetic circuit is the most likely to reach magnetic saturation in a small closed-drift ion source, usually where the inner path meets the back plate. Note that when the inner path reaches saturation in such a small ion source, magnetically permeable material cannot be added to relieve this saturation without changing the contours of the magnetic circuit adjacent to the region of interest, which would directly affect the shape of the magnetic field and therefore the ion source performance.

In contrast, if the outer paths of the magnetic circuit should approach saturation, magnetically permeable material could be added to the outside of the ion source, thereby. slightly increasing the outside dimensions of that source but not directly affecting the contours of the magnetic circuit adjacent to the region of interest.

In addition to considering the possible magnetic saturation of the magnetically permeable elements of the magnetic circuit, it is necessary to consider the level of performance desired for an ion source. As discussed by Zhurin, et al., in the aforesaid review paper in *Plasma Sources Science & Technology*, Vol. 8, beginning on page R1, the required gas flow, herein called F, varies directly with the diameter of the discharge region for similar operation of a geometrically scaled closed-drift source.

$$F\ D_M. \tag{7}$$

For efficient utilization of gas with a small ion beam current, a small diameter is thus necessary for the discharge region.

Figure 4:
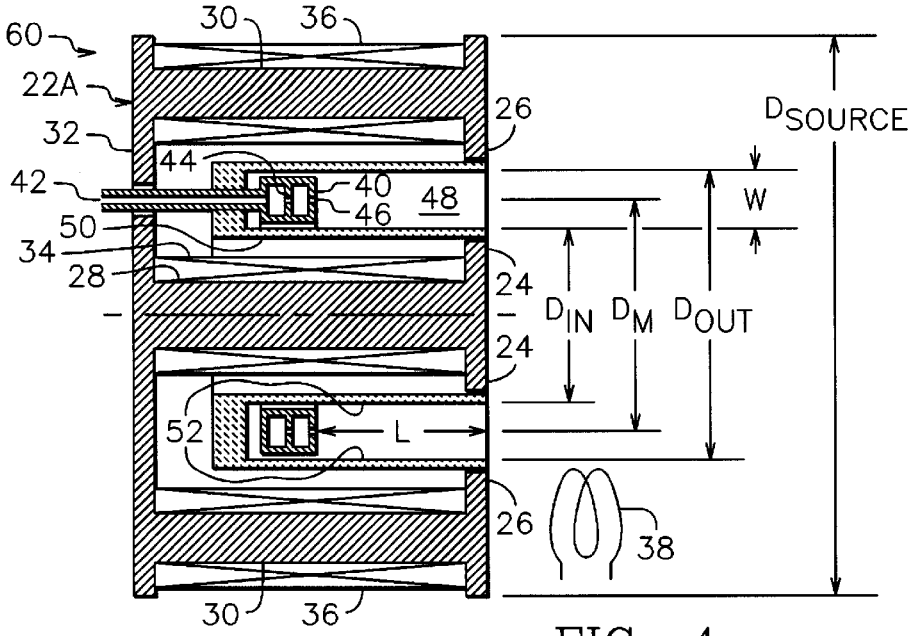
FIG. 4 (PRIOR ART)
FIG. 4 is a cross-sectional view of another prior-art closed-drift ion source.

Referring to FIG. 4, there is shown another approximately axisymmetric closed-drift ion source of the prior art. Ion source 60 in FIG. 4 has elements similar to those in FIG. 1 that function in a similar manner those in FIG. 1. The magnetic circuit 22A is generally similar to the magnetic circuit 22 in FIG. 1, but has different geometric proportions. The purpose in presenting the configuration shown in FIG. 4 is to show the consequences of reducing the discharge region and ion source diameters of the ion source shown in FIG. 1 to obtain a more compact ion source while, at the same time, keeping the same cross sections for the inner and outer paths together with the same dimensions for the inner and outer magnetically energizing coils.

Figure 5:
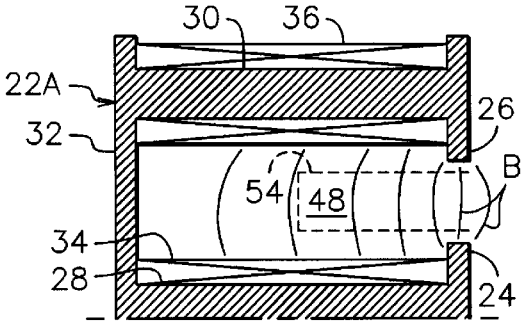
FIG. 5 (PRIOR ART)
FIG. 5 is a schematic cross-sectional view of the prior-art closed-drift ion source of FIG. 4 showing the shape of the magnetic field.

Referring now to FIG. 5, there is shown a schematic cross section of the closed-drift ion source shown in FIG. 4. The parts not associated with the magnetic circuit are again omitted in FIG. 5 in order to better show the shape of the magnetic field B. Except for the changes in relative diameters discussed in connection with FIG. 4, FIG. 5 is seen to be generally similar to FIG. 2. It is evident from FIG. 5 that the decreased radial distances between the inner and outer paths in the magnetic circuit result in increased magnetic field strengths in that portion of discharge region 48 that is upstream (to the left of) of pole pieces 24 and 26. Quantitatively, with approximately the same distribution of magnetostatic potential in the magnetic circuit in FIGS. 2 and 5, the magnetic field at the anode would be expected to vary approximately inversely as the radial distance between the inner and outer paths of the magnetic circuit.

Figure 6:
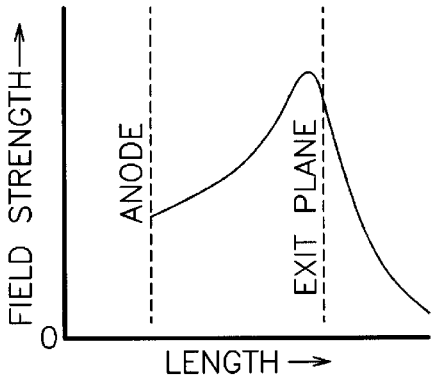
FIG. 6 (PRIOR ART)
FIG. 6 depicts the axial variation of the magnetic field strength in the closed-drift ion source of FIG. 4 at the mean diameter of the discharge region.

The changes in magnetic field strength are shown more clearly by comparing FIG. 6 with FIG. 3. The higher magnetic field near the anode of ion source 60 in FIGS. 4, 5, and 6, will result in both decreased efficiency and a decreased range of operation for that ion source compared to those performance parameters for ion source 20 shown in FIGS. 1, 2, and 3. In summary, obtaining a smaller, more compact ion source by simply reducing the outer radial dimensions of a configuration similar to that of ion source 20 is not an effective approach to obtain a compact, small ion source.

Figure 7:
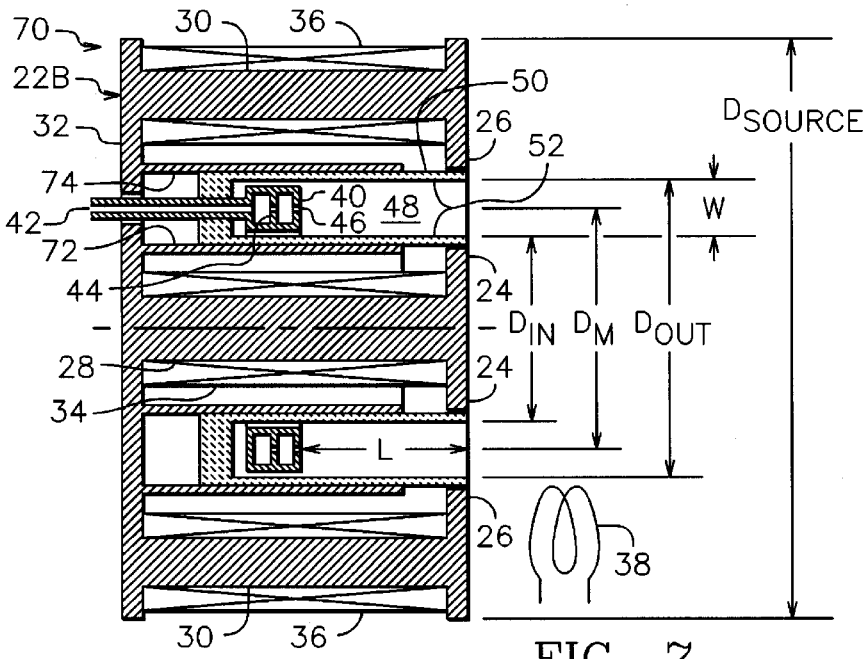
FIG. 7 (PRIOR ART)
FIG. 7 is a cross-sectional view of yet another prior-art closed-drift ion source.

Referring to FIG. 7, there is shown yet another approximately axisymmetric closed-drift ion source of the prior art. Ion source 70 in FIG. 7 is generally similar to ion source 60 shown in FIGS. 4, 5, and 6. The significant difference in magnetic circuit 22B is the addition of inner and outer magnetic shields 72 and 74 to ion source 70. The purpose of these magnetic shields is to reduce the magnetic field strength near the anode relative to the magnetic field strength between the inner and outer pole pieces 24 and 26 near the exit plane.

Figure 8:
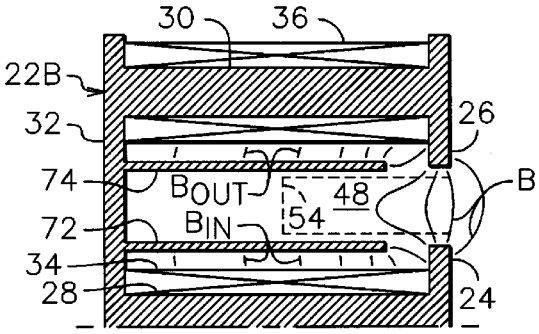
FIG. 8 (PRIOR ART)
FIG. 8 is a schematic cross-sectional view of the prior-art closed-drift ion source of FIG. 7 showing the shape of the magnetic field.
Figure 9:
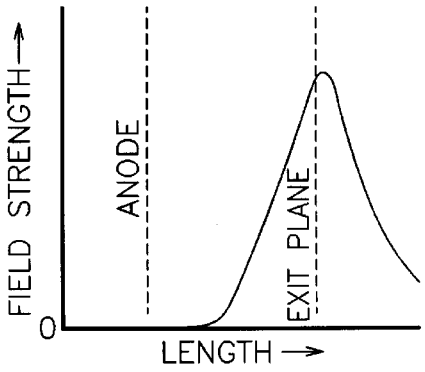
FIG. 9 (PRIOR ART)
FIG. 9 depicts the axial variation of the magnetic field strength in the closed-drift ion source of FIG. 7 at the mean diameter of the discharge region.

Referring now to FIG. 8, there is shown a schematic cross section of the closed-drift ion source shown in FIG. 7. The parts not associated with the magnetic circuit are again omitted in FIG. 8 in order to better show the shape of the magnetic field B. The effects of the magnetic shields are shown qualitatively in FIG. 8. That portion of the magnetic field that would in FIG. 5 add to the magnetic field strength near the anode is, in FIG. 8, shunted around the anode by the magnetically permeable magnetic shields. This effect is shown more quantitatively in FIG. 9. Despite the compact geometry of the ion source shown in FIGS. 7, 8, and 9, the magnetic field strength near the anode is quite low compared to the field strength between the pole pieces and near the exit plane.

From a magnetostatic viewpoint, the potential difference between inner pole piece 24 and inner magnetic shield 72 is, except for finite permeability effects in the involved magnetically permeable elements, generated by inner magnetically energizing coil 34 surrounding inner path 28. The potential difference between outer pole piece 26 and outer magnetic shield 74 is, except for finite permeability effects in the involved magnetically permeable elements, generated by outer magnetically energizing coils 36 surrounding outer paths 30. Inner and outer magnetic shields 72 and 74, together with that portion of backplate 32 located radially between them, constitute a magnetically permeable enclosure of approximately uniform magnetostatic potential on the upstream side (to the left in FIGS. 7 and 8) and on the radially inward and radially outward sides of anode 40. The presence of this enclosure, at a magnetostatic potential intermediate of the inner and outer pole pieces, is responsible for the low magnetic field strength near the anode.

To summarize the description of magnetic path 22B shown in FIG. 7, the inner and outer magnetic shields 72 and 74, together with that portion of backplate 32 located radially between them, constitute a magnetically permeable enclosure which, due to the continuous construction between shields and backplate, is at approximately uniform magnetostatic potential. A magnetizing means, inner magnetically energizing coil 34, introduces a magnetostatic potential difference between this enclosure and the inner pole piece. Another magnetizing means, outer magnetically energizing coils 36, introduce another magnetostatic potential difference between this enclosure and the outer pole piece.

The geometry of ion source 70 approximates that of U.S. Pat. No. 5,359,258, Arkhipov, et al. It should be noted that the ionization and acceleration regions are shifted downstream in the configuration of ion source 70 compared to that of ion source 20. Related to this change is the shift downstream (away from the anode) of the maximum in magnetic field, which can be beyond the exit plane at the mean region diameter, $D_M$.

Of significance to the invention herein is magnetic field $B_{in}$ between inner path 28 of the magnetic circuit and inner magnetic shield 72 and the magnetic field $B_{out}$ between outer path 30 of the magnetic circuit and outer magnetic shield 74. These portions of the magnetic field add to the flux densities in the inner and outer paths of the magnetic circuit without adding to the field strength between the pole pieces, which is the most effective portion of the magnetic field for ionization of the ionizable gas and the acceleration of the resultant ions. In particular, magnetic field $B_{in}$ between the inner path of the magnetic circuit and the inner magnetic shield adds to the flux density in the important inner path of the magnetic circuit.

As described in the preceding discussion, the use of magnetic shields permits a compact outside diameter for a given mean diameter of the discharge region, while keeping the magnetic field strength low at the anode. To this extent the use of magnetic shields permits the construction of a compact ion source. However, the magnetic flux between the inner shield and the inner path of the magnetic circuit increases the flux density in the critical inner path, thus increases the difficulty in using geometric scaling to reduce the mean discharge region diameter.

An additional prior art that can be cited is that of Guerrini, et al, in *Proceedings of the 24th International Electric Propulsion Conference* (Moscow, 1995) beginning on page 259. Guerrini, et al. used a magnetic circuit configuration with a cylindrical inner path and one magnetically energizing coil near the backplate. The inner pole piece was the same diameter as the inner path and there was no inner magnetically energizing coil, so that the inner diameter of the discharge region was only slightly larger than the diameter of the inner path. The required decrease in magnetic field strength near the anode was obtained by using a very large diameter for the outer path. For an outside diameter of the discharge region of 20 mm, the source length was 140 mm and the diameter was approximately 150 mm (see FIGS. 1 and 2 in Guerrini, et al.). Although Guerrini, et al., described their source as small, it was only the discharge region that was small, not the rest of the source. In addition to the large source diameter, the inner path of the magnetic circuit had an extended length so that the cumulative magnetic flux over this extended length was substantially larger than that flux required just for ionization and acceleration.

DESCRIPTION OF PREFERRED EMBODIMENTS

Figure 10:
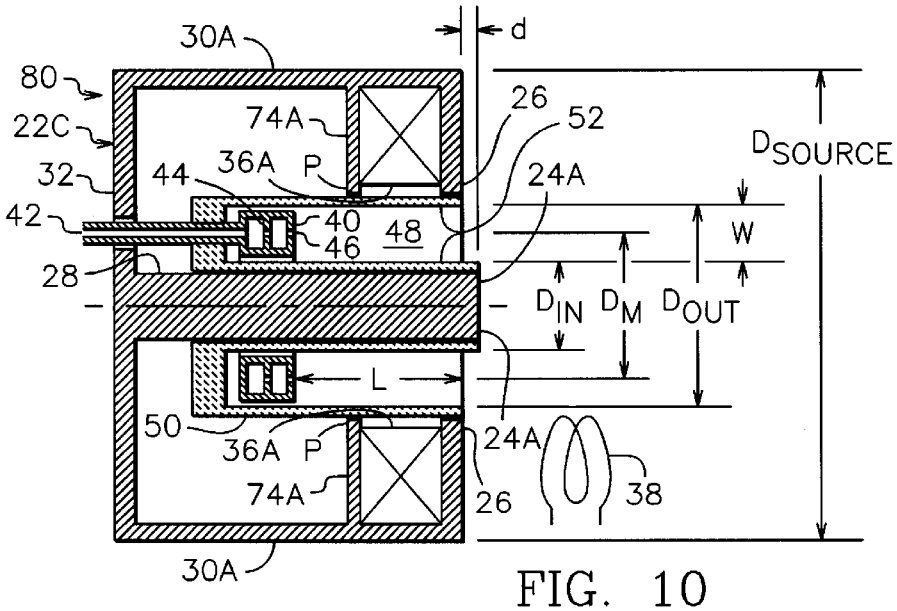
FIG. 10 is a cross-sectional view of a closed-drift ion source constructed in accordance with one specific embodiment of the present invention.

Referring to FIG. 10, there is shown an approximately axisymmetric closed-drift ion source constructed in accordance with one embodiment of the present invention. Ion source 80 includes a modified magnetic circuit 22C, which is comprised of magnetically permeable inner pole piece 24A, magnetically permeable outer pole piece 26, magnetically permeable inner path 28, magnetically permeable outer path or paths 30A, magnetically permeable back plate 32, magnetically permeable magnetic shield 74A, and magnetically energizing coil 36A, all of which serve, when coil 36A is energized by an appropriate source of electrical power, to generate a magnetic field between the inner and outer pole pieces. Electron-emitting cathode 38 is connected to the negative terminal of a typical discharge power supply (not shown), while anode 40 is connected to the positive terminal of the same power supply. Except for a single gas flow passage 42, the possible use of multiple outer paths 30A, and the usually laterally offset electron-emitting cathode 38, the apparatus shown in FIG. 10 is symmetric about a central axis. The frequently used dimensions $D_{IN}$, $D_{OUT}$, $D_M$, W, and $D_{SOURCE}$ are also shown in FIG. 10 and are defined in a consistent manner with the same dimensions used to describe the prior art. There is a minor difference in the definition of length L, in that inner pole piece 24A extends downstream of outer pole 26 and the length is arbitrarily defined as ending at the downstream end of the outer pole piece.

During operation, an ionizable gas again enters anode 40 through flow passage 42. The ionizable gas is uniformly distributed around the circumference within anode 40 by distributor means 44, and leaves through circumferentially distributed apertures 46. Some of the electrons emitted by cathode 38 flow back through discharge region 48 toward anode 40. These electrons ionize the molecules of ionizable gas leaving anode 40 through apertures 46, thereby generating a plasma, a gaseous mixture of electrons and ions, in discharge region 48. These electrons also interact with the magnetic field in region 48 to establish an axial electric field (not shown) within region 48. The ions that do not recombine with electrons on surfaces of anode 40 and walls 52 of discharge channel 50 are accelerated outward (to the right in FIG. 10) by the axial electric field to form an energetic ion beam. Some of the electrons that leave cathode 38 charge neutralize and, if necessary, current neutralize this ion beam.

Figure 11:
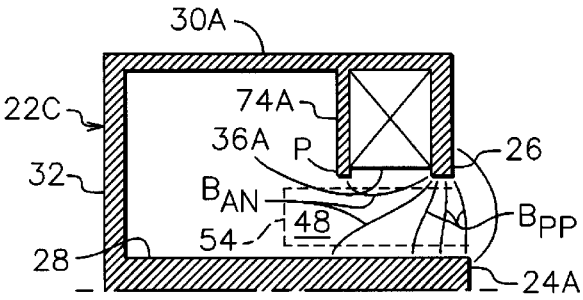
FIG. 11 is a schematic cross-sectional view of the closed-drift ion source of FIG. 10 showing the shape of the magnetic field.

Referring now to FIG. 11, there is shown a schematic cross section of the closed-drift ion source shown in FIG. 10. The parts not associated with the magnetic circuit are omitted in FIG. 11 in order to better show the shape of the magnetic field B. The boundary of the discharge region 48, defined at one end by anode 40 and laterally by discharge channel walls 52, is shown by dashed line 54.

Figure 12:
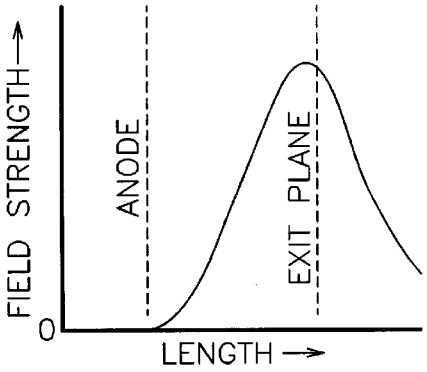
FIG. 12 depicts the axial variation of the magnetic field strength in the closed-drift ion source of FIG. 10 at the mean diameter of the discharge region.

The axial variation of magnetic field strength at the mean diameter of the discharge region for the ion source of FIG. 10 is shown in FIG. 12. The field strength is highest near the exit plane, in the vicinity of pole pieces 24A and 26, which are located on the radially inward and radially outward sides of discharge region 48. This high-strength region of magnetic field is again where most of the ion acceleration takes place. The field strength drops to a small value near the anode, which is desirable for high efficiency and stability over a wide operating range for a magnetic-layer type of closed-drift ion source, as described in the aforementioned review paper by Zhurin, et al., in *Plasma Sources Science & Technology.*

It can be noted in FIG. 10 that inner pole piece 24A differs from pole pieces in prior art FIGS. 1, 4, and 7 by having the same diameter as the inner path of the magnetic circuit; outer path or paths 30A of the magnetic circuit differ from the outer paths shown in prior art figures by not being enclosed by magnetically energizing coils; magnetically energizing coil 36A differs in being a single annular coil instead of multiple solenoidal coils enclosing the outer paths and is not used in conjunction with an inner magnetically energizing coil; and modified magnetic shield 74A is shown as extending radially inward from outer magnetic path or paths 30A instead of axially from backplate 32 as in prior art, in addition to not being used in conjunction with an inner magnetic shield. Some of these detailed changes from typical prior art are not required for an embodiment of the present invention, but are recited here for a complete description of FIG. 10.

The use of an inner pole piece 24A that is the same diameter as the inner magnetic path 28 is unusual, but was used previously by Guerrini, et al, in the aforementioned *Proceedings of the 24th International Electric Propulsion Conference* (Moscow, 1995) beginning on page 259. When such an inner pole piece is combined with the absence of an inner magnetically energizing coil between the inner wall of the discharge region and the inner path of the magnetic circuit, that inner wall can be reduced in diameter to near that of the inner path, permitting a reduced diameter for the discharge region. In the prior art of the aforementioned paper by Guerrini, though, a large source diameter relative to the discharge region diameter was required to obtain a sufficiently low magnetic field strength at the anode.

The use of a single magnetic coil or source of magnetic field, or a plurality of such sources acting in parallel and therefore acting effectively as a single source of magnetic field, is also unusual, but was used previously in the above cited paper by Guerrini, as well as in U.S. Pat. No. 5,763,989—Kaufman.

From the magnetostatic viewpoint, the magnetic circuit configuration of FIGS. 10 and 11 differs sharply from the prior art. Outer pole piece 26 is at one magnetostatic potential, while inner pole piece 24A, inner path 28, backplate 32, outer path or paths 30A, and magnetic shield 74A up to edge P are, except for finite permeability effects in these magnetically permeable elements, at another magnetostatic potential. The latter elements form a magnetically permeable enclosure of approximately uniform magnetostatic potential that is responsible for the low magnetic field strength at the anode. This enclosure is partially similar to the enclosure of inner and outer magnetic shields 72 and 74 and a portion of backplate 32 described in connection with FIGS. 7 and 8. However, the magnetostatic potential of this enclosure differs in that there is no inner magnetically energizing coil between the enclosure and the inner pole piece and therefore the magnetostatic potential of the enclosure is approximately that of the inner pole piece 24A in FIGS. 10 and 11. This difference in magnetostatic potential has two important effects.

First, the additional magnetic flux from an inner magnetic shield is avoided in the magnetic configuration of FIGS. 10 and 11. In FIG. 8, the useful flux in discharge region 48 is essentially that between pole pieces 24 and 26. This flux must pass through inner path 28. Due to the presence of magnetically energizing coil 34, the magnetic flux $B_{IN}$ between inner magnetic shield 72 and both inner path 28 and inner pole piece24 adds to the magnetic flux through inner path 28, thereby approaching magnetic saturation through inner path 28 near back plate 32. There is no inner magnetic shield or inner magnetically energizing coil in the configuration of FIGS. 10 and 11, so that the magnetic flux through the inner path of the magnetic circuit is reduced to approximately that flux required to ionize and accelerate the ionizable gas.

Second, the direction of the magnetic field $B_{AN}$ upstream of the pole pieces and near the anode is more axial than radial. This field direction near the anode differs dramatically from the previously used approximately radial direction over the entire discharge region, as shown in FIGS. 2, 5, and 8, and as also described by Zhurin, et al., in the aforesaid review in *Plasma Sources Science & Technology*, Vol. 8, beginning on page R1.

The aforementioned review paper by Zhurin, et al., is a review of approximately four decades of research on closed-drift ion sources and therefore constitutes a comprehensive source of technology on such ion sources. The ability to obtain efficient operation from a closed-drift ion source with a significant portion of the magnetic field (see magnetic field $B_{AN}$ in FIG. 11) departing substantially from the previously used approximately radial direction is clearly an unexpected result.

Having obtained this result, though, a possible explanation can be given for the excellent performance described in the Specific Example section. As described by Zhurin, et al., in the aforesaid review paper in *Plasma Sources Science & Technology*, Vol. 8, beginning on page R1, the axial electric field that accomplishes the ion acceleration in a typical closed-drift ion source of the magnetic-layer type is concentrated in the high magnetic field region near the pole pieces—much more strongly concentrated than the magnetic field itself (see FIG. 10 in Zhurin, et al.). The magnetic field near the pole pieces $B_{pp}$ in FIG. 11 herein is in the approximately radial direction, thus has a satisfactory orientation in the region where the axial electric field would be expected to be concentrated. On the other hand, the field upstream of the pole pieces and near the anode $B_{AN}$ in FIG. 11 departs substantially from the preferred approximately radial direction, but this departure is perhaps less important because the axial electric field would be expected to be small in this region.

To summarize the description of magnetic circuit 22C shown in FIG. 10, the magnetic shield 74A up to edge P, together with outer magnetic path or paths 30A, backplate 32, and the upstream portion of inner magnetic path 28, constitute a magnetically permeable enclosure at approximately uniform magnetostatic potential due to the proximity of adjacent elements, one to the next. Inner pole piece 24A is at approximately the magnetostatic potential of this magnetically permeable enclosure due to its proximity to permeable elements of this enclosure. A magnetizing means, magnetically energizing coil 36A, introduces a magnetostatic potential difference between outer pole piece 26 and this permeable enclosure.

Please note that the magnetically permeable enclosure need not be at a uniform magnetostatic potential. It is only necessary that the potential differences be small compared to the differences between the inner and outer pole pieces, so that the magnetic field within the enclosure is small compared to the magnetic field between those pole pieces. in practise, it is often useful to make small adjustments in the shape of the magnetic field. These adjustments can be made by adjusting the thicknesses of the elements that comprise the enclosure or, in the case of physically separate elements, installing thin nonmagnetic layers between adjacent elements. The essential requirement is that a magnetically permeable enclosure be formed, by one or more permeable elements in close proximity, one to the next, so that the magnetic field within this enclosure is small compared to that between the pole pieces.

The ion source of FIGS. 10 and 11 is seen to satisfy the requirements for a small closed-drift ion source. The inner wall of the discharge channel can be reduced to near the diameter of the inner path of the magnetic circuit, so that the maximum cross section for the inner path of the magnetic circuit can be used for a given size of discharge region. In addition, this result is accomplished with a compact configuration for the outer portions of the magnetic circuit so that a small overall source diameter can be used without compromising performance. Furthermore, the maximum possible reduction in size by geometric scaling before encountering saturation of the inner magnetic path should be assured by the absence of any extraneous magnetic flux to the inner path of the magnetic circuit, such as the flux to the inner magnetic shield shown in FIG. 7, or the flux to the long inner path length described in the aforementioned paper by Guerrini, et al, in the *Proceedings of the 24th International Electric Propulsion Conference* (Moscow, 1995) beginning on page 259.

The procedure in the initial operation of an ion source of the type shown in FIG. 1, as well as those in FIGS. 4 and 7, is to optimize the current ratio between the inner magnetically energizing coil 34 and the one or more outer magnetically energizing coils 36. The equivalent optimization in the ion source of FIGS. 10 and 11 is accomplished by testing with different lengths of the inner path of the magnetic circuit. For a collimated (minimum divergence) ion beam, the inner pole piece typically extends slightly beyond the outer pole piece, as indicated by the distance d in FIG. 10. In space propulsion, a collimated ion beam is preferred. In industrial applications, however, both focused and divergent beams are often of interest. A more divergent ion beam can be obtained by extending the inner path and increasing the distance d. A more focused ion beam can be obtained by decreasing the distance d, or even making this distance negative (moving the inner pole piece upstream of the outer pole piece).

Figure 13:
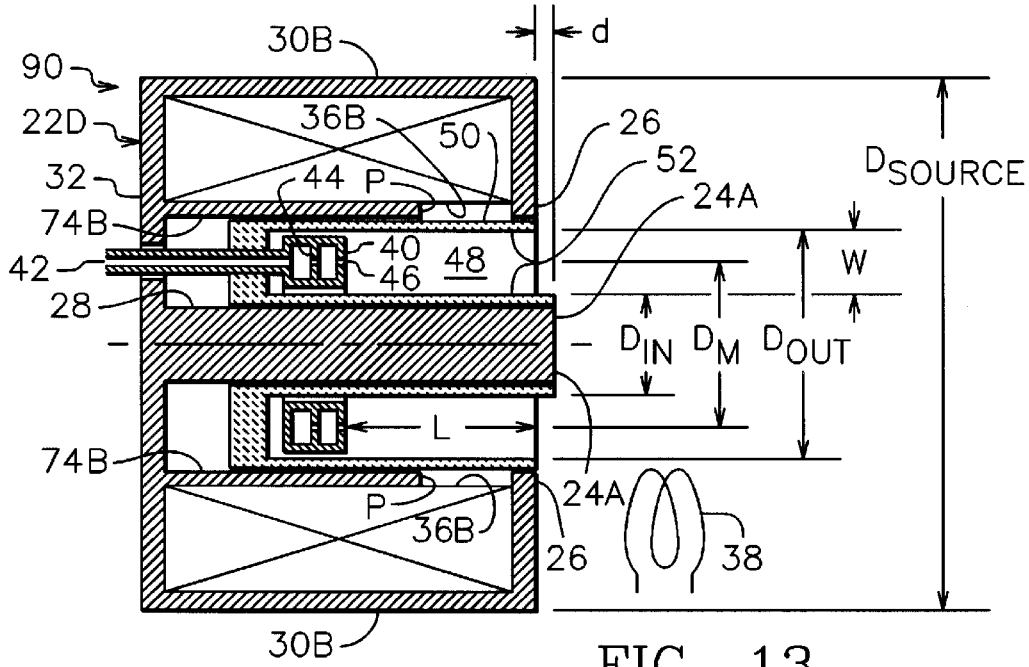
FIG. 13 is a cross-sectional view of another closed-drift ion source constructed in accordance with another specific embodiment of the present invention.

Referring to FIG. 13, there is shown an approximately axisymmetric closed-drift ion source constructed in accordance with an alternate embodiment of the present invention. Ion source 90 includes a modified magnetic circuit 22D, which is comprised of magnetically permeable inner pole piece 24A, magnetically permeable outer pole piece 26, magnetically permeable inner path 28, magnetically permeable outer path or paths 30B, magnetically permeable back plate 32, magnetically permeable magnetic shield 74B, and magnetically energizing coil 36B, all of which serve, when coil 36B is energized by an appropriate source of electrical power, to generate a magnetic field between the inner and outer pole pieces. Electron-emitting cathode 38 is connected to the negative terminal of a typical discharge power supply (not shown), while anode 40 is connected to the positive terminal. The operation of ion source 90 is similar to that of ion source 80 in FIG. 10.

The differences between ion source 90 in FIG. 13 and ion source 80 in FIG. 10 are that the magnetically energizing coil 36B differs in being an annular coil that extends the full length of the ion source instead of being confined to a region near the outer pole piece, and modified magnetic shield 74B is still used without an inner magnetic shield but is now shown as extending from the backplate.

When examined from the viewpoint of magnetostatic potential and the shape of magnetic field produced within the discharge region, however, ion source 90 is similar in essential features to that produced within ion source 80. A magnetically permeable enclosure at an approximately uniform magnetostatic potential is again formed by magnetically permeable elements of the magnetic circuit, and the magnetostatic potential of this enclosure is again approximately the same as that of the inner pole piece. The enclosure is comprised of magnetic shield 74B up to edge P, a portion of backplate 32, and the upstream portion of inner magnetic path 28, which are at approximately uniform magnetostatic potential due to the continuous construction of these elements. Inner pole piece 24A is at approximately the magnetostatic potential of this magnetically permeable enclosure due to its proximity to permeable elements of this enclosure, i.e., the inner pole piece is the end of the inner path 28. A magnetizing means, magnetically energizing coil 36B, introduces a magnetostatic potential difference between outer pole piece 26 and this permeable enclosure. Note that, although the magnetically energizing coil extends nearly the full length of ion source 90, the presence of magnetic shield 74B causes the magnetostatic potential difference to be introduced to the region of interest between edge P and outer pole piece 26. With similar boundary conditions for the region of interest surrounding the discharge region, the magnetic fields will be similar for ion sources 80 and 90, and with similar magnetic fields the performance of these sources will also be similar with similar operating conditions.

Figure 14:
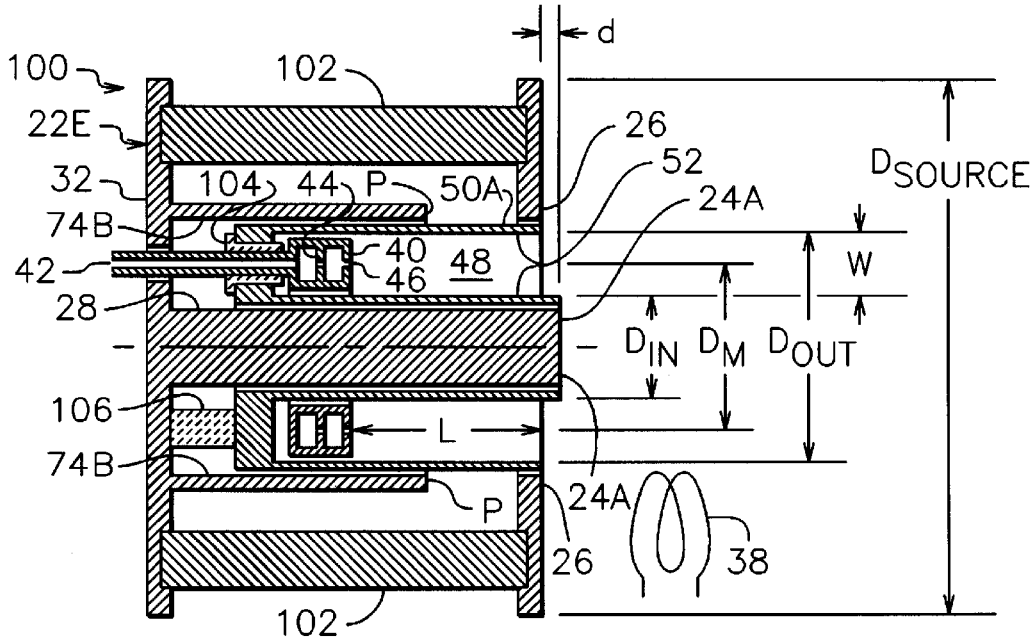
FIG. 14 is a cross-sectional view of yet another closed-drift ion source constructed in accordance with yet another specific embodiment of the present invention.

Referring to FIG. 14, there is shown an approximately axisymmetric closed-drift ion source constructed in accordance with another alternate embodiment of the present invention. Magnetically energizing coil 36B and outer magnetic path 30B of ion source 90 in FIG. 13 are replaced by one or more permanent magnets 102 in ion source 100. Similar to magnetically energizing coil 36B in FIG. 13, permanent magnets 102 extend nearly the full length of the ion source, but the magnetostatic potential difference is again introduced to the region of interest between edge P and outer pole piece 26.

There is also the change from dielectric discharge channel 50 in FIG. 13 to conducting discharge channel 50A in FIG. 14. Due to the conducting nature of the channel in FIG. 14, it is necessary to support and electrically isolate the anode from the discharge channel with insulators, of which insulator 104 is an example. It is also necessary to support and electrically isolate the discharge channel from the magnetic circuit, which is typically at ground potential (the potential of the surrounding vacuum chamber in an industrial application or the potential of the spacecraft in a space propulsion application). Insulator 106 is an example of an insulator performing the latter function.

When examined from the viewpoint of magnetostatic potential and the shape of magnetic field produced within the discharge region, ion source 100 is essentially the same as ion sources 80 and 90. A magnetically permeable enclosure with an approximately uniform magnetostatic potential is again formed by magnetically permeable elements of the magnetic circuit due to the proximity of adjacent elements, one to the next, and the magnetostatic potential of this enclosure is again approximately the same as that of the inner pole piece. The performance for ion source 100 will, except for performance changes due to the change in discharge channel material, be similar to that for ion sources 80 and 90.

For yet another alternate embodiment, the permanent magnets in FIG. 14 could be replaced by magnetically permeable outer paths enclosed by solenoidal magnetically energizing coils, similar to the outer paths 30 and outer magnetically energizing coils 36 in FIGS. 1, 4, and 7. This replacement would again have little or no effect on the magnetic field within the discharge region.

SPECIFIC EXAMPLE

Figure 15:
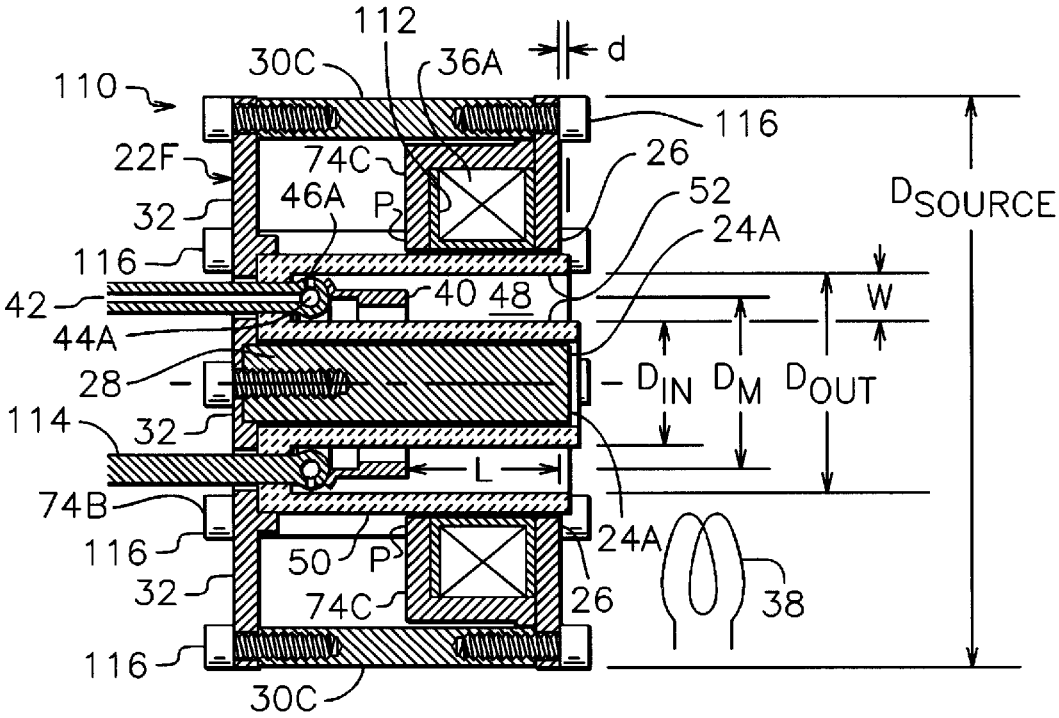
FIG. 15 is a cross-sectional view of a specific closed-drift ion source constructed in accordance with a specific embodiment of the present invention and tested to demonstrate excellent performance in a small closed-drift ion source.

Referring to FIG. 15, there is shown an approximately axisymmetric closed-drift ion source constructed in accordance with an embodiment of the present invention and generally similar to that embodiment shown in FIG. 10. Ion source 110 includes a modified magnetic circuit 22F, which is comprised of magnetically permeable inner pole piece 24A, magnetically permeable outer pole piece 26, magnetically permeable inner path 28, eight magnetically permeable outer paths 30C, magnetically permeable back plate 32, magnetically permeable magnetic shield 74C, and magnetically energizing coil 36A, all of which serve, when coil 36A is energized by an appropriate source of electrical power, to generate a magnetic field between the inner and outer pole pieces. The length of the discharge region L is shown in FIG. 15 as extending from the anode 40 to the downstream end of outer pole piece, similar to the length L shown in FIGS. 10, 13, and 14. The channel walls can extend downstream of the pole pieces in a closed-drift ion source and the definition of L in FIG. 15 arbitrarily ignores such extensions therein.

All of the magnetically permeable components in ion source 110 are fabricated of annealed low-carbon steel. Coil 36A is wound on form 112, which is fabricated of nonmagnetic stainless steel. Electron-emitting cathode 38 is a hollow cathode and is connected to the negative terminal of the discharge power supply (not shown), while anode 40 is connected to the positive terminal. There is a single gas flow passage 42 for the ionizing gas to be introduced to distributor means 44A, which in this configuration is a circumferential passage that is large compared to the total area of the circumferentially distributed apertures 46A, so that the gas is uniformly distributed in the circumferential direction. In addition to the tube enclosing the gas flow passage 42, there are three anode supports 114 to support the anode in a circumferentially uniform position. These supports, as well as the anode and the gas flow tube, are constructed of nonmagnetic stainless steel. The discharge channel 50 is constructed of borosil, a mixture of powdered boron nitride and silica that is pressed and baked before machining.

The outer diameter of the discharge region, $D_{out}$, is 20 mm, while the diameter of the ion source, $D_{source}$, is 53 mm. The assembled ion source is held together with 17 screws 116, eight at each end that are threaded into eight outer paths 30C and one that is threaded into inner path 28. There is an additional nonmagnetic structure (not shown) that is used to support and locate the tube enclosing the gas flow passage and the anode supports as well as electrically isolate these components from other components. The requirements of such a structure should be readily apparent to one skilled in the art.

It can be noted that the anode is located closely on the upstream side of coil 36A in FIG. 15 compared to the anode location in FIG. 10. This close location resulted in a need for the magnetic field strength to drop more rapidly in the upstream direction for the configuration in FIG. 15 in order to reach a negligible field strength near the anode. This need was satisfied by reducing the diameters of outer paths 30C to 3 mm. This reduction in diameter resulted in a small magnetostatic potential difference across the length of outer paths 30C, so that magnetostatic potential difference from outer pole piece 26 to edge P of magnetic shield 74C was slightly greater than the magnetostatic potential difference between outer pole piece 26 and inner pole piece 24A. It should be evident to one skilled in the art of magnetic circuit design that a similar effect on magnetic field shape could have been obtained by used larger diameters for outer paths 30C and either reducing the thickness of backplate 32 or introducing a small nonpermeable gap between backplate 32 and inner path 28. In all cases the magnetically permeable elements that form a permeable enclosure of approximately uniform magnetostatic potential remain in close proximity. By using small variations in shape or the insertion of small gaps between the elements, small adjustments in magnetic-field can be made. For purposes of this invention, it is recognized that a plurality of discrete magnetically permeable elements can also be brazed, welded, or otherwise fastened together to form a unitary mechanical structure, and such structure is considered to be a "plurality of magnetically permeable elements."

Ion source 110 shown in FIG. 15 was operated at a background pressure of $1.3\times10^{-4}$ Torr (17 milliPascals) with an argon gas flow of 8.4 standard cubic centimeters per minute (sccm) through the ion source and an argon gas flow of 3.3 sccm through the hollow cathode, which was used as the electron-emitting cathode 38. The current through coil 36A was sufficient to give a maximum magnetic field strength at the mean diameter of 150 Gauss (0.015 Tesla). At a discharge voltage between the anode and cathode of 200 V, the discharge current was 0.39 A and the ion beam current was 0.21 A. This performance is excellent for a closed-drift ion source that is only 53 mm in overall diameter and is operating on argon. As described by Zhurin, et al., in the aforesaid review paper in *Plasma Sources Science & Technology*, closed-drift ion sources operate more efficiently on gases with high atomic weights. It is outstanding performance for a small closed-drift ion source to operate efficiently on a light gas such as argon.

ALTERNATE EMBODIMENTS

The magnetically energizing coils in FIGS. 10, 13, and 15 and the permanent magnets in FIG. 14 have been shown as being located outside of the discharge region and often also near the downstream end of same. Because of the enclosure of approximately uniform magnetostatic potential around much of the discharge region, the magnetic field in this region is nearly isolated from whatever magnetically energizing means is used. There is therefore a wide range of latitude for the placement of the magnetizing means relative to the discharge region.

The magnetic-layer type of closed-drift thruster has typically had a discharge region length that is long compared to its width (L>W) and such a configuration is assumed herein. The magnetic-layer type of closed-drift ion source has also typically had dielectric walls. Recent trends in closed-drift ion sources are described by Zhurin, et al., in the aforesaid review paper in *Plasma Sources Science & Technology*, Vol. 8, beginning on page R1. Among these trends are the use of closed-drift designs that are of essentially the magnetic-layer type, but the discharge chamber walls are fabricated of a conductor, as was shown in FIG. 14. In U.S. Pat. No. 5,892,329—Arkhipov, et al., the discharge channel walls are constructed simultaneously of both dielectric material and conductors. In view of these variations in discharge channel material that are available to one skilled in the art, embodiments of this invention should not be limited to discharge channels fabricated of a dielectric material.

Configurations that are essentially axisymmetric have been assumed herein. Because the gas flow required is generally proportional to the total length of the closed-drift path in the circumferential direction, the benefits of the present invention are most apparent in an axially symmetric configuration. However, benefits of a more compact design could also be obtained using this invention in a configuration where the closed-drift discharge region is of an elongated or "race-track" shape. FIGS. 10, 13, and 14 could describe such configurations, except that the shape would be more elongated in one cross section than it is in another cross section normal to the first, so that the configuration is not radially symmetric. For an elongated or "race-track" shape of closed-drift discharge region, the radially inward and radially outward locations relative to the discharge region are more conveniently described as being located at one side and the other of the discharge region.

In a similar manner, the ion beam has been assumed to be generated in a generally axial direction. It is also possible to utilize the present invention to construct more compact closed-drift ion sources where the ion beam is directed in a radial or conical direction.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A compact closed-drift ion source comprising:

means defining a closed-drift discharge region in which the length of said region is larger than its width and into which an ionizable gas is introduced;

an anode located at one end of said region;

an electron-emitting cathode located near the other end of said region;

a first pole piece located at one side of said discharge region and near said other end of said region;

a second pole piece located at the other side of said discharge region and near said other end of said region;

a magnetic circuit comprised of a plurality of magnetically permeable elements and at least one magnetizing means, said magnetic circuit extending from said first pole piece to said second pole piece and being generally disposed on said one end of said region with said anode being located between said permeable elements and said region;

discharge means for generating ions from said ionizable gas and accelerating said ions toward said other end;

means for enabling said accelerated ions to leave from said other end of said region;

characterized by at least one of said permeable elements providing a permeable enclosure at said one end of said region;

wherein said permeable element or elements that form said enclosure, said first pole piece, and any intermediate said permeable elements of said magnetic circuit have close proximity of adjacent elements, one to the next; and wherein said magnetizing means is located only between said second pole piece and said permeable enclosure.

2. A compact closed-drift ion source comprising:

means defining an approximately annular closed-drift discharge region in which the length of said region is larger than its width and into which an ionizable gas is introduced;

an anode located at one longitudinal end of said region;

an electron-emitting cathode located near the other longitudinal end of said region;

a first pole piece located at the radially inward side of said discharge region and near said other longitudinal end of said region;

a second pole piece located at the radially outward side of said discharge region and near said other longitudinal end of said region;

a magnetic circuit comprised of a plurality of magnetically permeable elements and at least one magnetizing means, said magnetic circuit extending from said first pole piece to said second pole piece and being generally disposed on said one end of said region with said anode being located between said permeable elements and said region;

discharge means for generating ions from said ionizable gas and accelerating said ions toward said other longitudinal end;

means for enabling said accelerated ions to leave from said other longitudinal end of said region;

characterized by at least one of said permeable elements providing a permeable enclosure at said one end of said region;

wherein said permeable element or elements that form said enclosure, said first pole piece, and any intermediate said permeable elements of said magnetic circuit have close proximity of adjacent elements, one to the next; and wherein said magnetizing means is located only between said second pole piece and said permeable enclosure.

3. A closed-drift ion source as defined in claim 1 or 2, further characterized by the side boundaries of said discharge region comprised of discharge chamber walls fabricated of a dielectric material.

4. A closed-drift ion source as defined in claim 1 or 2, further characterized by the side boundaries of said discharge region comprised of discharge chamber walls fabricated of a conducting material.

5. A closed-drift ion source as defined in claim 1 or 2, further characterized by said magnetizing means being comprised of one or more permanent magnets.

6. A closed-drift ion source as defined in claim 1 or 2, further characterized by said magnetizing means being comprised of one or more magnetically energizing coils.

7. A method for constructing a compact closed-drift ion source wherein an ionizable gas is introduced therein and of the type including:

means defining a closed-drift discharge region in which the length of said region is larger than its width and into which an ionizable gas is introduced;

an anode located at one end of said region;

an electron-emitting cathode located near the other end of said region;

a first pole piece located at one side of said region and near said other end of said region;

a second pole piece located at the other side of said region and near said other end of said region;

a magnetic circuit composed of magnetically permeable elements and a magnetizing means, said magnetic circuit extending from said first pole piece to said second pole piece and being generally disposed on said one end of said region with said anode being located between elements of said magnetic circuit and said region;

discharge means for generating ions from said ionizable gas and accelerating said ions toward said other end;

means for enabling said accelerated ions to leave from said other end of said region;

wherein the method comprises the steps of:

a. arranging at least one of said permeable elements of said magnetic circuit to form a permeable enclosure at said one end of said region;

b. arranging said permeable element or elements that form said enclosure, said first pole piece, and any intermediate permeable elements of said magnetic circuit so that adjacent elements have close proximity, one to the next; and c. arranging said magnetizing means so that it is located only between said second pole piece and said permeable enclosure.

8. A method for constructing a compact closed-drift ion source wherein an ionizable gas is introduced therein and of the type including:

means defining an approximately annular closed-drift discharge region in which the length of said region is larger than its width and into which an ionizable gas is introduced;

an anode located at one longitudinal end of said region;

an electron-emitting cathode located near the other longitudinal end of said region;

a first pole piece located at the radially inward side of said region and near said other longitudinal end of said region;

a second pole piece located at the radially outward side of said region and near said other longitudinal end of said region;

a magnetic circuit composed of magnetically permeable elements and a magnetizing means, said magnetic circuit extending from said first pole piece to said second pole piece and being generally disposed on said one end of said region with said anode being located between elements of said magnetic circuit and said region;

discharge means for generating ions from said ionizable gas and accelerating said ions toward said other longitudinal end;

means for enabling said accelerated ions to leave from said other longitudinal end of said region;

wherein the method comprises the steps of:

a. arranging at least one of said permeable elements of said magnetic circuit to form a permeable enclosure at said one end of said region;

b. arranging said permeable element or elements that form said enclosure, said first pole piece, and any intermediate permeable elements of said magnetic circuit so that adjacent elements have close proximity, one to the next; and c. arranging said magnetizing means so that it is located only between said second pole piece and said permeable enclosure.

* * * * *